US006835253B1

(12) United States Patent
Kawalla et al.

(10) Patent No.: US 6,835,253 B1
(45) Date of Patent: Dec. 28, 2004

(54) METHOD FOR PRODUCING A HOT STRIP

(75) Inventors: Rudlof Kawalla, Niederbobritzsch (DE); Bernhard Engl, Dortmund (DE); Thomas Heller, Duisburg (DE); Wolfgang Rasim, Wesel (DE); Eberhard Sowka, Dinslaken (DE)

(73) Assignee: Thyssenkrupp Stahl AG, Duisburg (DE)

( * ) Notice: Subject to any disclaimer, the term of this patent is extended or adjusted under 35 U.S.C. 154(b) by 0 days.

(21) Appl. No.: 10/111,119

(22) PCT Filed: Sep. 16, 2000

(86) PCT No.: PCT/EP00/09063

§ 371 (c)(1),
(2), (4) Date: Jul. 22, 2002

(87) PCT Pub. No.: WO01/29273

PCT Pub. Date: Apr. 26, 2001

(30) Foreign Application Priority Data

Oct. 20, 1999 (DE) ..... 199 50 502

(51) Int. Cl.[7] ..... C21D 8/04

(52) U.S. Cl. ..... 148/547; 148/541; 148/602; 148/603; 148/598; 148/599

(58) Field of Search ..... 148/541, 547, 148/602, 603, 598, 599, 546, 548

(56) References Cited

U.S. PATENT DOCUMENTS 4,092,178 A 5/1978 Onoe et al.
4,576,657 A 3/1986 Satoh et al.
5,665,181 A 9/1997 Rohde

FOREIGN PATENT DOCUMENTS

EP 0345206 A 12/1989
FR 2544333 A 10/1984

*Primary Examiner*—Deborah Yee
(74) *Attorney, Agent, or Firm*—Proskauer Rose LLP

(57) ABSTRACT

The invention relates to a method for producing a hot strip, in particular for producing a hot strip intended for the production of a cold strip with good deep-drawing characteristics; in which a steel melt comprising (in % by weight) C:≦0.07%, Si:≦0.5%, Mn:≦2.5%, Al:≦0.1%, N:≦0.01%, P:≦0.025, B:≦0.05, if need be up to a total of 0.35% of Nb, Ti and V, with the remainder being iron and the usual impurities is melted; in which the steel melt is continually output in one strand (S) from a permanent casting mould (1); in which the cast strand (S) immediately after discharge from the permanent casting mould (1) is led along a cooling line (2); in which the strand (S) is intensively cooled down to a temperature of $A_{r1}$±25 K at a cooling rate ($a_{LM}$) of at least 3 K/s; in which, following its intensive cooling, the strand (S) is cooled by exposure to air for at least 30 seconds; and in which the strand (S) itself or thin slabs (D) divided off the strand (S) is/are reheated in a soaking furnace (5) before the strand (S) or the thin slabs (D) are hot rolled to form hot strip. The method according to the invention makes it possible, during processing of low-alloyed low-carbon steels, to reduce the required temperature in the soaking furnace such that the stress on the furnace is reduced without there being any reduction in the quality of the hot strip produced, or of the cold strip made from said hot strip.

12 Claims, 3 Drawing Sheets

METHOD FOR PRODUCING A HOT STRIP

BACKGROUND OF THE INVENTION

The invention relates to a method for producing a hot strip, in particular for producing a hot strip intended for the production of a cold strip with good deep-drawing characteristics, made of a low-carbon low alloyed steel, in which thin slabs are produced by continuous strand casting; in which the strand emerging from a permanent casting mould during continuous strand casting passes along a cooling line; and in which the cast strand itself or thin slabs divided off the strand are reheated in a soaking furnace before they are hot rolled to form hot strip.

In a known method of the above-mentioned type, which has become known as the "CSP method", thin slabs are divided off a steel strand produced in a continuous strand casting plant and after temperature equalisation in a tunnel furnace, are subjected to rolling in a multistand mill train so as to form hot strip. In the known method, as a rule the thin slabs enter the soaking furnace at a temperature between 950° C. and 1100° C. and are reheated therein to a temperature between 1100° C. and 1200° C.

By using the heat present in the strand after casting, the known method makes it possible to produce hot strip with reduced energy expenditure when compared to other conventional methods of this type. However, with this method, the soaking furnace must be operated at very high temperatures. Such high temperatures cause rapid wear of the furnace so that the cost of furnace maintenance negates the benefit of energy gains achieved. Nonetheless the high temperatures in the soaking furnace are required in the state of the art so as to keep in, or bring to, solution, the alloying constituents in the steel strand, said constituents during subsequent process steps in the production of the hot strip or of the cold strip made from said hot strip, causing precipitation which has a decisive influence on the formation of a particular microstructure in the finished hot strip or in the cold strip produced therefrom.

From EP 0 686 702 A1 a modification of the above-mentioned method is known in which the surface temperature of the slab between the permanent casting mould and the soaking furnace is lowered in an adequate way to such an extent that a microstructural transformation from austenite to ferrite/pearlite takes place in the slab. It is further stated that the temperature attained during this process at a depth of 2 mm below the slab surface is preferably below 600° C.

It is the aim of the measures described in EP 0 686 702 A1 to achieve a situation in which even such slabs which as a result of the addition of substantial quantities of secondary scrap to the melt contain significant amounts of copper, enter the soaking furnace in a state by which excessive accumulation of copper in the region of the grain boundaries of the primary austenite is prevented. Otherwise such accumulation causes very considerable scale formation and in further stages of hot strip production can cause so-called soldering fractures. By cooling the slabs to a temperature below the $A_{r3}$ temperature (the temperature below which transformation of austenite to ferrite takes place), a microstructure transformation with re-orientation of the austenite grain boundaries is enforced during reheating in the soaking furnace.

Slabs which are cooled in this way are reheated in the soaking furnace to the high temperature to which the soaking furnace is usually set. In order to expend as little energy as possible for reheating, in the method known from EP 0 686 702 A1, the depth of cooling and the time intended for cooling are reduced to a minimum so that the temperature in the interior of the slab is as high as possible when the slab enters the soaking furnace.

Attempts to minimise both the wear of the soaking furnace and the energy expenditure required for its operation, by reducing the furnace temperature have shown that such a reduction in temperature in particular during processing of low-alloyed low-carbon steels has a negative influence on the formation of precipitation in the subsequent process of hot strip production and cold strip production.

SUMMARY OF THE INVENTION

It is thus the object of the invention, in a process of the type mentioned above, during processing of low-alloyed low-carbon steels to reduce the required temperature in the soaking furnace such that the stress on the furnace is reduced without there being any reduction in the quality of the hot strip produced, or of the cold strip made from said hot strip.

According to the invention this object is met by a method for producing a hot strip, in particular for producing a hot strip intended for the production of a cold strip with good deep-drawing characteristics; in which a steel melt comprising (in % by weight) C:≦0.07%, Si:≦0.5%, Mn:≦2.5%, Al:≦0.1%, N:≦0.01%, P:≦0.025, B:≦0.05, if need be up to a total of 0.35% of Nb, Ti and V, with the remainder being iron and the usual impurities; in which the steel melt is continually output from a permanent casting mould; in which the cast strand immediately after discharging from the permanent casting mould is led along a cooling line; in which the strand is intensively cooled down to a temperature of $A_{r1}$±25 K at a cooling rate of at least 3 K/s; in which, following its intensive cooling, the strand is cooled by exposure to air for at least 30 seconds; and in which the strand itself or thin slabs divided off the strand is/are reheated in a soaking furnace before the strand or the thin slabs are hot rolled to form hot strip.

Since according to the invention the strand emerging from the permanent casting mould is subjected to intensive cooling at cooling rates of at least 3 K/s, during which cooling the strand is cooled to a temperature of $A_{r1}$±25 K (the temperature at which the transformation from austenite to ferrite is completed), the precipitation required to achieve the desired material characteristics of the hot strip, is in a targeted way already introduced in the region in front of the soaking furnace. Thus, during cooling by exposure to air, which cooling follows intensive cooling, there is sufficient time available for the precipitation processes to be essentially complete at the time of entry into the soaking furnace. At the same time, homogenisation of the temperature in the strand takes place so that there is an even temperature distribution at the time of entry into the furnace.

Since the formation of precipitation has essentially been completed prior to entry into the soaking furnace, the furnace temperature can be limited to a temperature which is below the reheating temperature applied in the conventional approach. Advantageously, the soaking furnace temperature to be adhered to according to the invention is in a range whose lower limit is determined by the $A_{r3}$ temperature and whose upper limit is 1150° C.

A reheating temperature of max. 1050° C. is sufficient if the hot strip produced according to the invention is used for the production of a cold strip which after cold rolling is annealed in a continuous annealing furnace. In this case, preferably no precipitation processes take place during any reheating connected with the production of the hot strip and cold strip, such process steps following reheating, so that it is no longer necessary to bring to solution any alloying constituents which take part in the formation of precipitation.

By contrast, if from the hot strip produced according to the invention, a cold strip is rolled which after cold rolling is annealed in a hood-type annealing furnace, then the temperature in the soaking furnace, during heating of the strand or the thin slabs, should be in the range from 1100° C. to 1150° C. If the heating temperature exceeds 1100° C., sufficient Al nitride will become soluble to produce a desirable "pancake" microstructure during hood-type annealing.

It has been found that a strip produced according to the invention has a fine-grained microstructure which has a favourable effect on the deep-drawability of a cold strip made from the hot strip. Thus in essence the invention provides a method which makes it possible to reduce the temperature in the soaking furnace, so that the service life of said soaking furnace is prolonged and the economy of the method, when compared to the conventional approach, is improved. In addition, the method according to the invention results in a product which is outstandingly suitable for processing by way of deep-drawing.

Preferably several roll passes are made during hot rolling, wherein the finish-rolled hot strip is 2 to 5 mm in thickness. In the last roll pass a thickness reduction of $\epsilon_h$>15% should be attained. The hot strip rolled in this way has a particularly fine-grained microstructure which further improves its deep-drawability. In this context "deformation $\epsilon_h$" refers to the ratio of thickness reduction during the last roll pass to the thickness of the strip at the time of entry into the last roll stand of the hot-rolling mill train. Accordingly, the thickness of a hot strip prior to the last-roll pass is for example $h_0$. Following the last roll pass, the thickness of the strip is reduced to $h_1$. According to the definition there is thus a deformation in the last roll pass of $\epsilon_h$ to $(h_0-h_1)/h_0>15\%$ where $h_0$=thickness of the hot strip at the time of entry into the last roll stand, and $h_1$=thickness of the finish-rolled hot strip.

If hot rolling is to be carried out with the microstructure of the hot strip being in the austenitic range, then the finish-roll temperature on completion of hot rolling is preferably at least 20° C. above the $A_{r3}$ temperature. If by contrast, an essentially ferritic microstructure of the hot strip is desired after hot rolling, then it is advantageous if the finishing temperature on completion of hot rolling is below the $A_{r1}$ temperature +50° C.

From the point of view of deep-drawing characteristics, a further improvement of the microstructure of a cold strip made from the hot strip according to the invention, can be achieved in that the total deformation $\epsilon_{ges}$, achieved during cold rolling of the hot strip, is at least 60%. In this context "total deformation $\epsilon_{ges}$" refers to the ratio of thickness reduction during cold rolling to the thickness of the non-rolled strip at the time of entry into the cold-roll stand. According to this definition, the thickness of a hot strip produced according to the invention is for example $h_0$ after hot rolling. After cold rolling, the thickness of the strip has been reduced to $h_1$. According to the definition, there is thus a total deformation of $\epsilon_{ges}$ to $(h_0-h_1)/h_0$ where $h_0$=thickness of the hot strip at the time of entry into the cold-roll stand, and $h_1$=thickness of the finish-rolled cold strip.

If, as mentioned above, the cold strip produced from the hot strip, after cold rolling is annealed in a continuous annealing furnace, then the finish-rolled hot strip should be coiled at a coiling temperature of at least 650° C. Adherence to this minimum temperature promotes the formation of precipitation in the coiled hot strip so that recrystallisation of the cold strip can take place during continuous annealing, unhindered by precipitation.

By contrast, if a cold strip is produced which is to be annealed in a hood-type annealing furnace after cold rolling, then the finish-rolled hot strip should first be coiled at a coiling temperature of max 625° C. In this way the remainder of the alloying constituents which are still present in the dissolved state and which take part in the formation of precipitation, are kept in solution. During hood-type annealing during which the cold strip is exposed for an extended period to a temperature which is lower than the temperature during continuous annealing, precipitation forms in the cold strip which precipitation is required for the formation of the desired pancake microstructure in the cold strip.

BRIEF DESCRIPTION OF THE DRAWINGS

Below, the invention is explained in more detail by means of a drawing showing one embodiment and by means diagrams. The following is diagrammatically shown.

DETAILED DESCRIPTION OF THE INVENTION

A melt of a low-carbon low-alloyed steel is poured via a permanent casting mould 1 to a steel strand S which measures between 20 and 70 mm in thickness.

Figure 1:
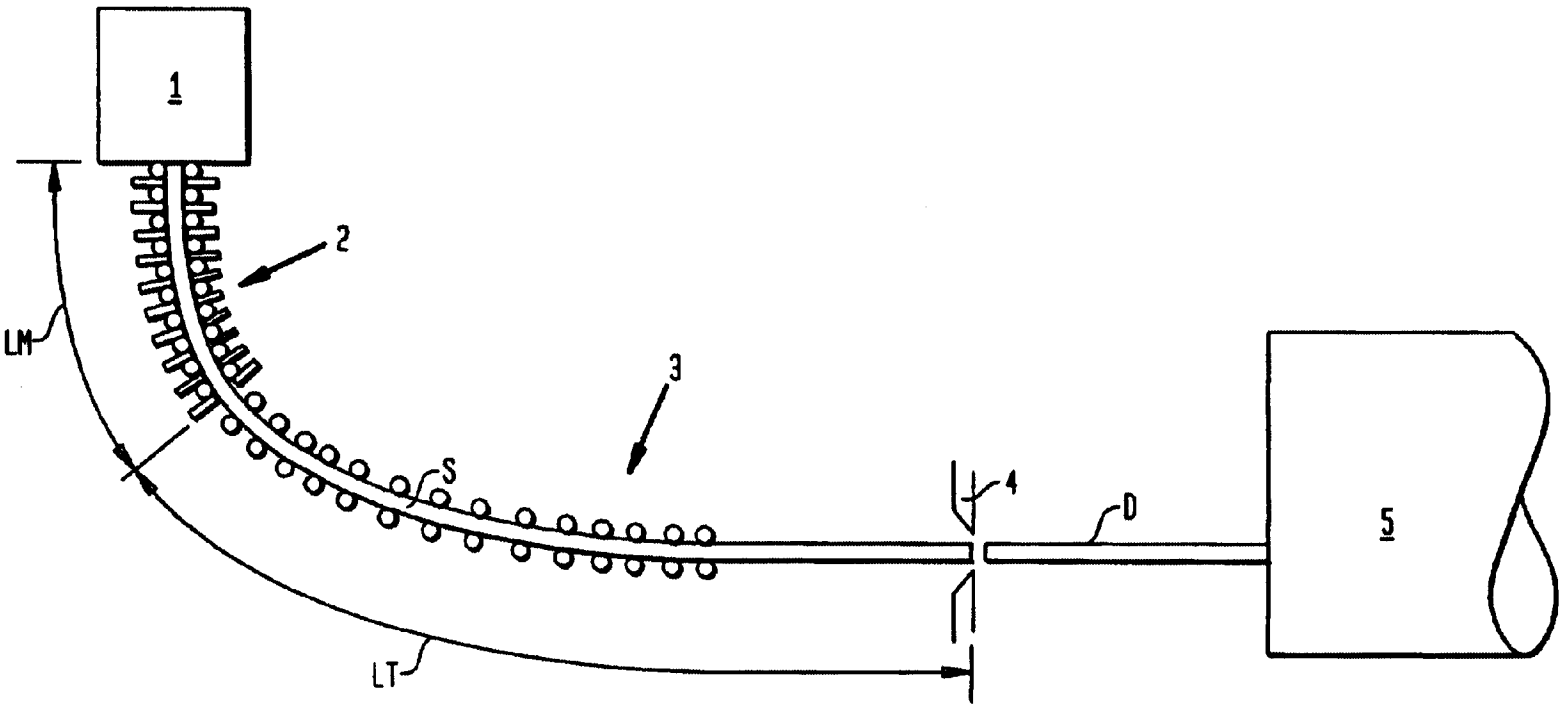
FIG. 1 a lateral view of the start of a production line for producing a hot strip from a cast steel strand.
Figure 2:
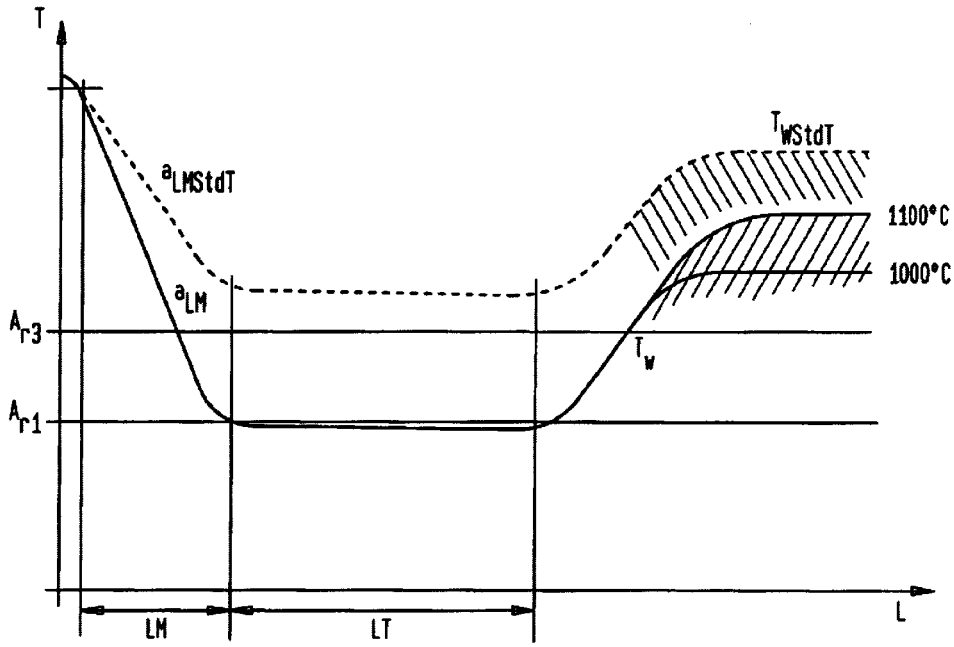
FIG. 2 the gradient of $A_{r1}$ and $A_{r3}$ temperature depending on the carbon content of a low-carbon steel.

Immediately after discharge from ther permanent casting mould 1, the steel strand S, as it travels along a "metallurgical length" LM, is intensively cooled by cooling water which, from cooling devices 2 arranged on both sides of the steel strand S, is directed towards said steel strand S. The cooling, rate $a_{LM}$ achieved during the intensive cooling of the steel strand S within the metallurgical length LM is at least 3 K/s, with the actually set cooling, rate $a_{LM}$ depending on the respective thermal conductivity of the steel strand S and the required temperature $T_{LM}$ at the end of the metallurgical length LM. In any case, the extent of intensive cooling is such that the temperature $T_{LM}$ of the steel strand S at the end of the metallurgical length LM is $A_{r1}$±25° C., for example 710° C. FIG. 2 shows the position of the $A_{r1}$ temperature depending on the carbon content of the composition of the steel strand S.

Following the metallurgical length LM with the cooling devices 2 positioned on said metallurgical length LM, the steel strand S passes on a roller table 3 along a cooling line LT in which cooling of the steel strand S takes place by exposure to air. The steel strand S takes at least 30 seconds to pass along the cooling line LT so that at the end of the cooling line LT the formation of precipitation in the steel strand S is essentially complete and the temperature distribution is homogenous. After passing the cooling line LT, depending on the design of the finishing line, the steel strand S itself, or thin slabs D divided off from it by means of a dividing-off device 4, enter a soaking furnace 5.

In the soaking furnace 5, which is designed as a tunnel furnace, the steel strand S or the thin slab D is/are heated to a reheat temperature $T_w$ which is above the $A_{r3}$ temperature, but below 1100° C. The position of the $A_{r3}$ temperature is also shown in FIG. 2, depending on the carbon content of the steel composition.

The temperature $T_w$ attained during reheating in the soaking furnace 5 depends on the annealing treatment which is carried out during further processing of the hot strip from the steel strand S or the thin slabs D, to form cold strip. If the cold strip which is cold rolled from the hot strip is subjected to annealing in a hood-type annealing furnace, then the reheat temperature $T_w$ is in the region of 1100° C. By contrast, if the cold strip after cold rolling is subjected to continuous annealing, then the reheat temperature $T_w$ is approx. 1000 C.

Figure 3:
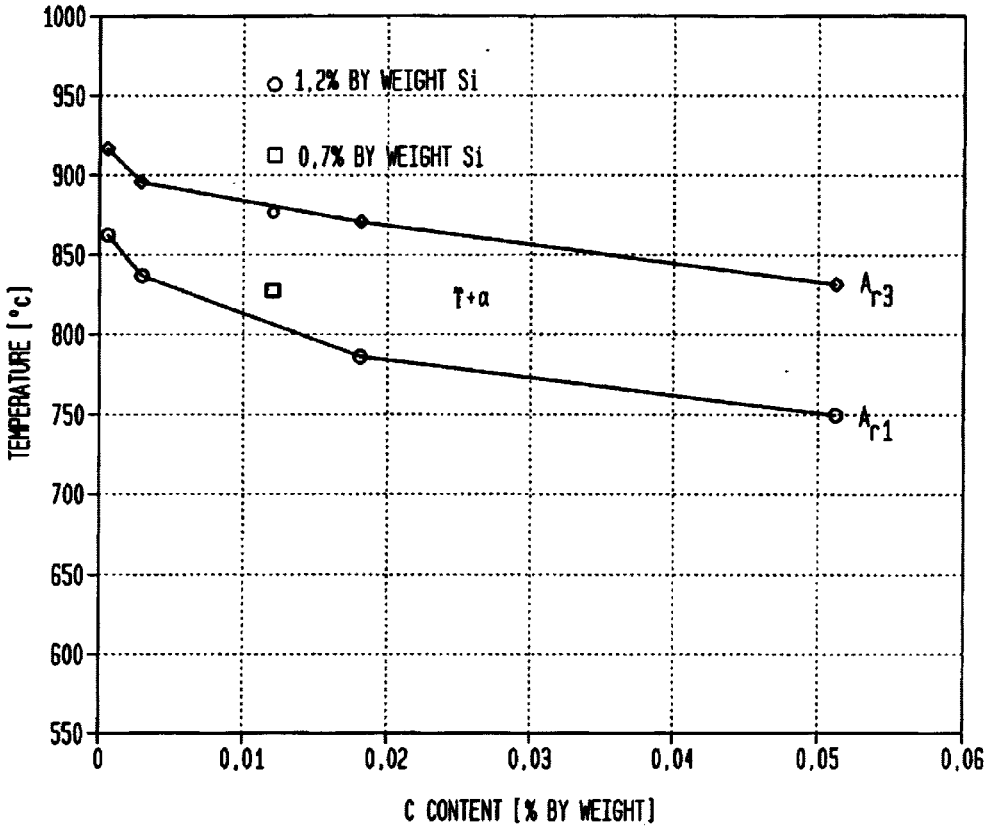
FIG. 3 the temperature gradient of the strand in the region of the start of a production line shown in FIG. 1.

FIG. 3 shows the temperature gradient of the steel strand S in the method according to the invention in a solid line. In addition, in dashed lines, it shows the gradient of the steel strand S which occurs with the method according to the state of the art. It is clearly evident that with conventional processing of a strand from a low-carbon low-alloyed steel, the cooling rate $a_{LMStdT}$ in the region of the metallurgical length LM is significantly lower than is the case of the method according to the invention; that the temperature does not fall below the $A_{r3}$ temperature, and that the upper limit of the reheat temperature $T_{wStD}$ is significantly above the upper limit of reheating of 1100° C. in the invention.

LIST OF REFERENCE CHARACTERS

| | |
|---|---|
| 1 | Permanent casting mould |
| 2 | Cooling devices |
| 3 | Roller table |
| 4 | Dividing-off device |
| 5 | Soaking furnace |
| D | Thin slabs |
| LM | Metallurgical length |
| LT | Cooling line |
| L | Path axis of Diag. 2 |
| S | Steel strand |
| T | Temperature axis of Diag. 2 |
| $T_{LM}$ | Temperature at the end of the metallurgical length LM |
| $T_W$ | Reheat temperature |
| $T_{WStdT}$ | Reheat temperature in the state of the art |

What is claimed is:

1. A method for producing a hot rolled strip with good deep-drawing characteristics, said method comprising: melting a steel melt comprising in % by weight:

| | | |
|---|---|---|
| C: | ≦ | 0.07% |
| Si: | ≦ | 0.5% |
| Mn: | ≦ | 2.5% |
| Al: | ≦ | 0.1% |
| N: | ≦ | 0.01% |
| P: | ≦ | 0.025% |
| B: | ≦ | 0.05% |

up to a total of 0.35% of Nb, Ti and V, balance iron and inevitable impurities;

continually outputting the steel melt from a permanent casting mould to form a strand;

leading the cast strand along a cooling line immediately after discharging from the permanent casting mould;

intensively cooling down the cast strand to a temperature of $A_{r1}$±25 K at a cooling rate $a_{LM}$ of at least 3K/s;

cooling the cast strand by exposure to air for at least 30 seconds following the intensively cooling down step; and reheating in a soaking furnace the strand or thin slabs divided off the strand followed by hot rolling the strand or the thin slabs to form hot rolled strips.

2. The method of claim 1 further comprising reheating the strand or the thin slab in the soaking furnace to a temperature above $A_{r3}$ temperature, but not exceeding 1100° C.

3. The method of claim 1, wherein the thin slabs measure between 20 and 70 mm in thickness.

4. The method of claim 1 further comprising making several hot roll passes during hot rolling, wherein a finish-rolled hot strip is 2 to 5 mm in thickness.

5. The method of claim 4, further comprising attaining a thickness reduction of the finish-rolled hot strip of $\epsilon_h$>15% in the last roll pass of the hot rolling step.

6. The method of claim 4, wherein a finish-roll temperature on completion of the hot rolling step is at least 20° C. above the $A_{r3}$ temperature.

7. The method of claim 4, wherein the finish-roll temperature on completion of the hot rolling step is below the $A_{r1}$ temperature +50° C.

8. The method of claim 4, further comprising cold rolling the hot rolled strip to make a cold rolled strip from the hot rolled strip, wherein the total deformation $\epsilon_{ges}$, achieved during the cold rolling step is at least 60%.

9. The method of claim 8 further comprising annealing the cold rolled strip in a continuous furnace wherein the temperature during heating the strand or the thin slabs in the soaking furnace does not exceed 1050° C.

10. The method of claim 4, further comprising coiling the finish-rolled hot strip at a coiling temperature of at least 650° C.

11. The method of claim 8, further comprising annealing the cold rolled strip in a hood annealing furnace wherein the temperature during heating the strand or the thin slabs in the soaking furnace ranges from 1100° C. to 1150° C.

12. The method of claim 4, further comprising coiling the finish-rolled hot strip at a coiling temperature of 625C maximum.

* * * * *